US012235000B2

(12) United States Patent
Yoshikawa et al.

(10) Patent No.: US 12,235,000 B2
(45) Date of Patent: Feb. 25, 2025

(54) HEAT SOURCE UNIT FOR A HEAT PUMP

(71) Applicants: DAIKIN INDUSTRIES, LTD., Osaka (JP); DAIKIN EUROPE N.V., Ostend (BE)

(72) Inventors: Kouta Yoshikawa, Ostend (BE); Wim Vansteenkiste, Ostend (BE); Akshay Hattiangadi, Ostend (BE); Jose Daniel Garcia Lopez, Ostend (BE); Tom Surmont, Ostend (BE); Rishi Mehta, Ostend (BE)

(73) Assignees: DAIKIN INDUSTRIES, LTD., Osaka (JP); DAIKIN EUROPE N.V., Ostend (BE)

( * ) Notice: Subject to any disclaimer, the term of this patent is extended or adjusted under 35 U.S.C. 154(b) by 115 days.

(21) Appl. No.: 17/436,825

(22) PCT Filed: Feb. 14, 2020

(86) PCT No.: PCT/JP2020/005754
§ 371 (c)(1),
(2) Date: Sep. 7, 2021

(87) PCT Pub. No.: WO2020/184060
PCT Pub. Date: Sep. 17, 2020

(65) Prior Publication Data

US 2022/0178557 A1 Jun. 9, 2022

(30) Foreign Application Priority Data

Mar. 8, 2019 (EP) ..... 19161607

(51) Int. Cl.
*F24F 1/12* (2011.01)

(52) U.S. Cl.
CPC ..... *F24F 1/12* (2013.01)

(58) Field of Classification Search
CPC ..... F24F 1/12; H02K 5/24; F25B 2500/13; F25B 2500/12; F04B 39/0033
See application file for complete search history.

(56) References Cited

U.S. PATENT DOCUMENTS 4,982,812 A * 1/1991 Hwang ..... F24F 13/24 415/119
7,398,855 B2 * 7/2008 Seel ..... F01C 21/10 181/202

(Continued)

FOREIGN PATENT DOCUMENTS

AP 9-222245 A 8/1937
CN 101178059 A 5/2008

(Continued)

OTHER PUBLICATIONS

English language translation of CN107504595. Translated May 2024 (Year: 2017).*

(Continued)

*Primary Examiner* — Cassey D Bauer
(74) *Attorney, Agent, or Firm* — Birch, Stewart, Kolasch & Birch, LLP

(57) ABSTRACT

A heat source unit for a heat pump having a refrigerant circuit, the heat source unit having: an outer casing including a bottom plate; and a compressor assembly accommodated in the outer casing, the compressor assembly including a compressor of the refrigerant circuit of the heat pump including a compressor housing, a support plate supporting the compressor, the support plate being mounted via dampers to the bottom plate, and a compressor casing enclosing the compressor and the compressor housing. A damping mechanism is arranged between the compressor and the support plate, and the compressor casing is fixed to the support plate out of contact with the compressor housing.

6 Claims, 6 Drawing Sheets

(56) References Cited

U.S. PATENT DOCUMENTS

| | | | | |
|---|---|---|---|---|
| 8,348,218 | B2 * | 1/2013 | Logan | H02K 5/24 417/363 |
| 8,950,208 | B2 * | 2/2015 | Bae | F24F 1/08 62/295 |

FOREIGN PATENT DOCUMENTS

| | | | | | |
|---|---|---|---|---|---|
| CN | 101280887 | A | | 9/2008 | |
| CN | 203595201 | U | | 5/2014 | |
| CN | 106091454 | A | | 11/2016 | |
| CN | 107504595 | A | * | 12/2017 | F24F 1/10 |
| EP | 2159497 | B1 | | 11/2016 | |
| EP | 3290697 | A1 | | 3/2018 | |
| JP | 11-182891 | A | | 7/1999 | |
| JP | 2005-241197 | A | | 9/2005 | |
| JP | 2018-115788 | A | | 7/2018 | |

OTHER PUBLICATIONS

International Preliminary Report on Patentability and Written Opinion of the International Searching Authority for International Application No. PCT/JP2020/005754, dated Sep. 23, 2021.
International Search Report, issued in PCT/JP2020/005754, PCT/ISA/210, dated May 14, 2020.
Search Report issued in European priority application 19161607.7, dated Sep. 16, 2019.

* cited by examiner

[Fig. 1]
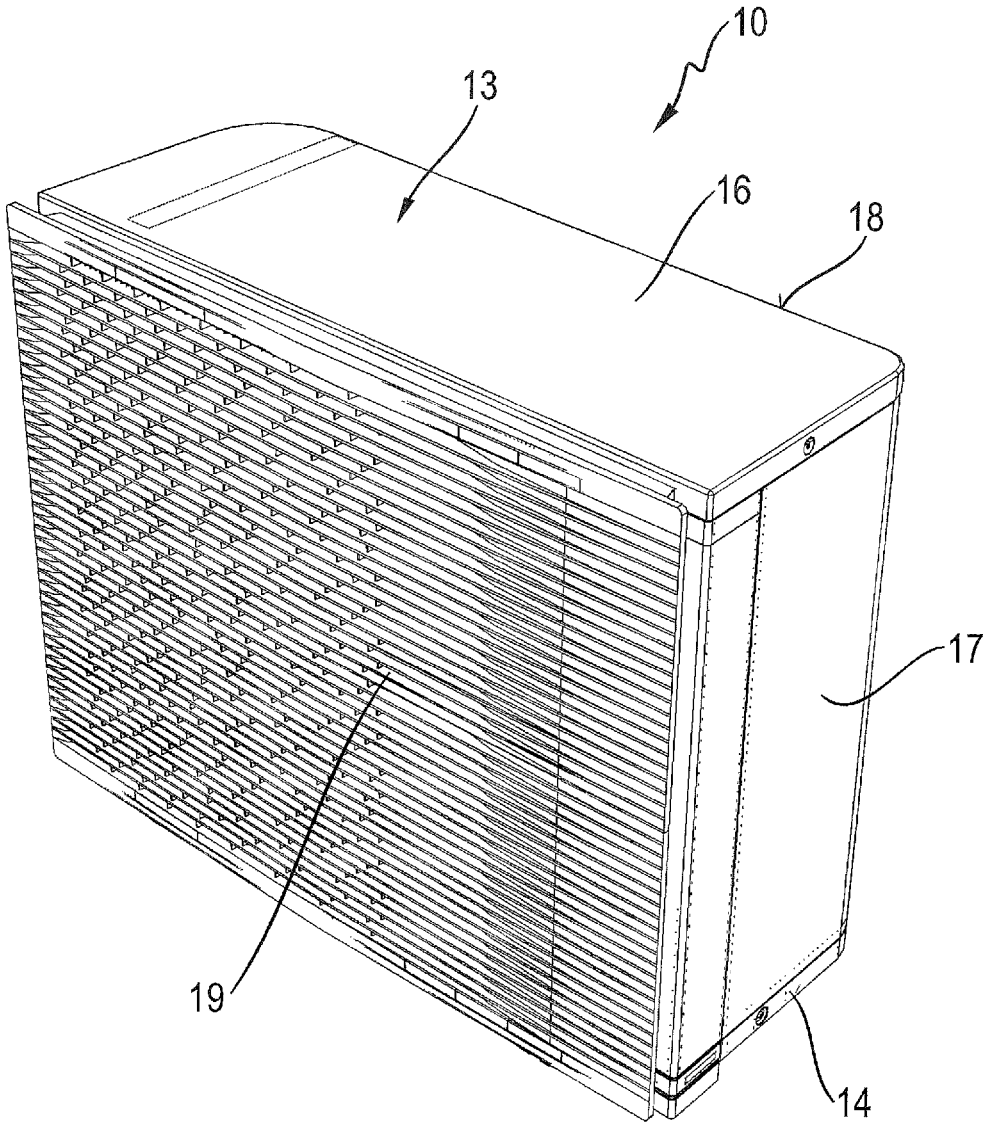

[Fig. 2]
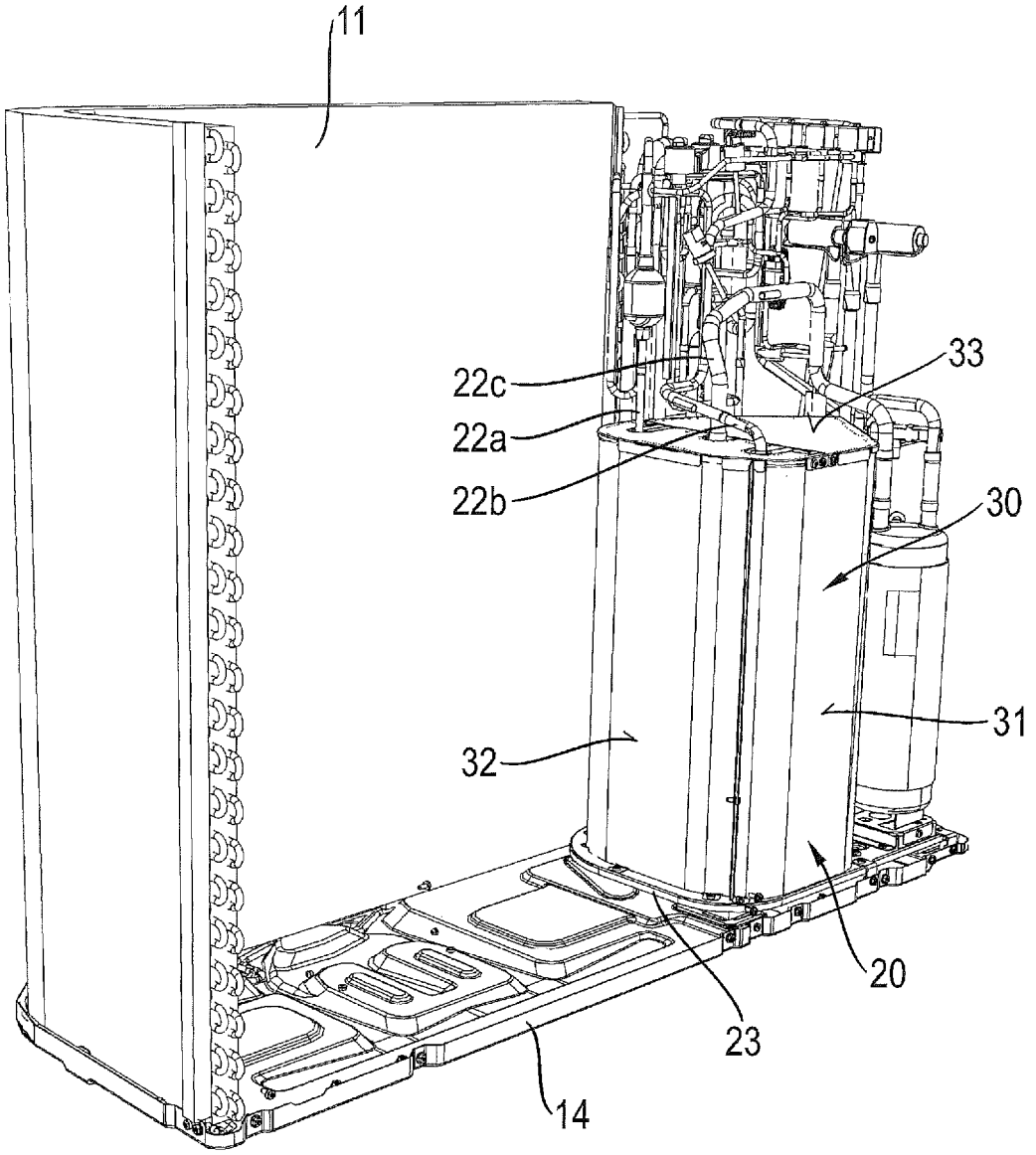

[Fig. 3A]
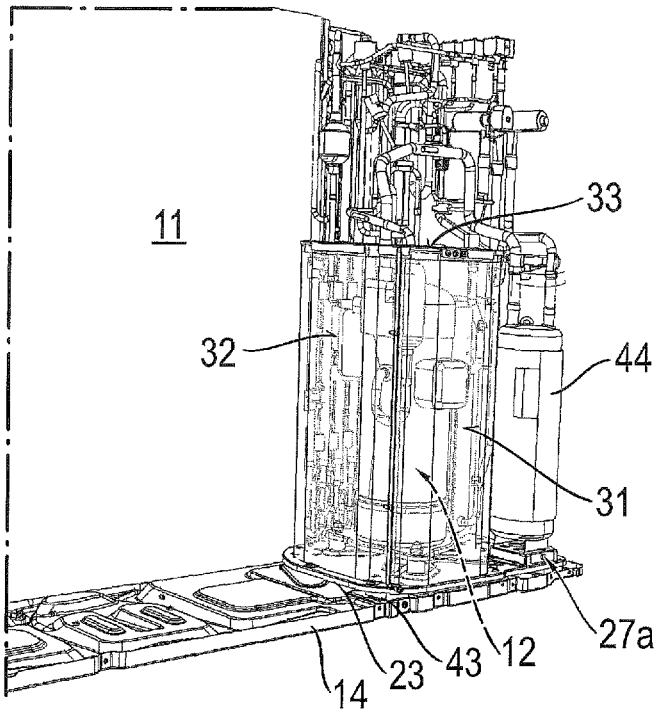
[Fig. 3B]
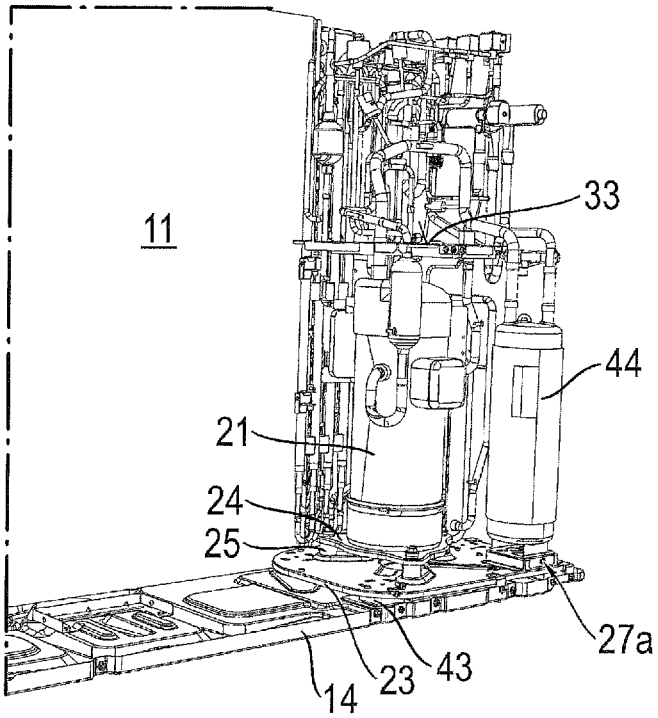

[Fig. 4]
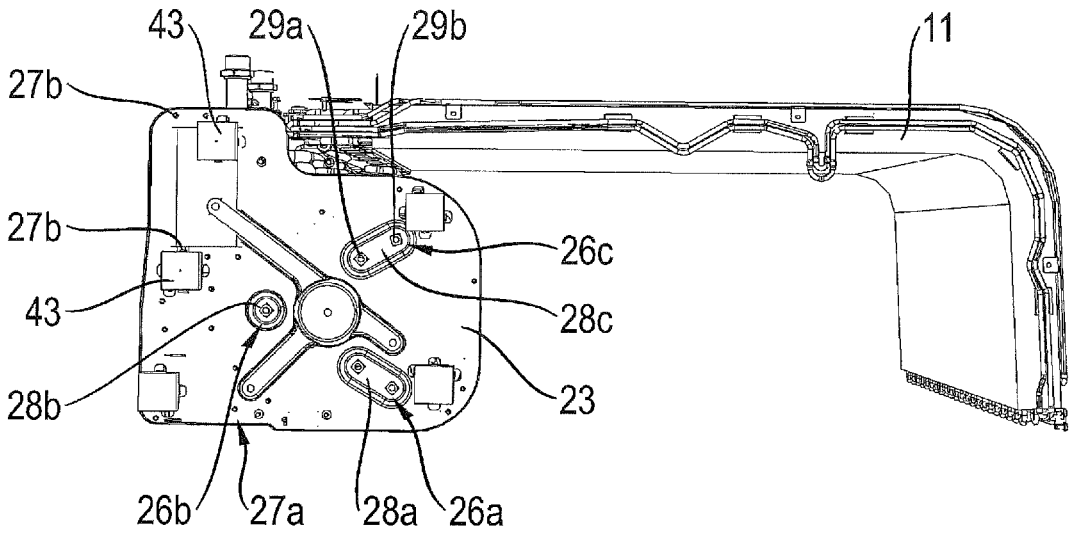
[Fig. 5]
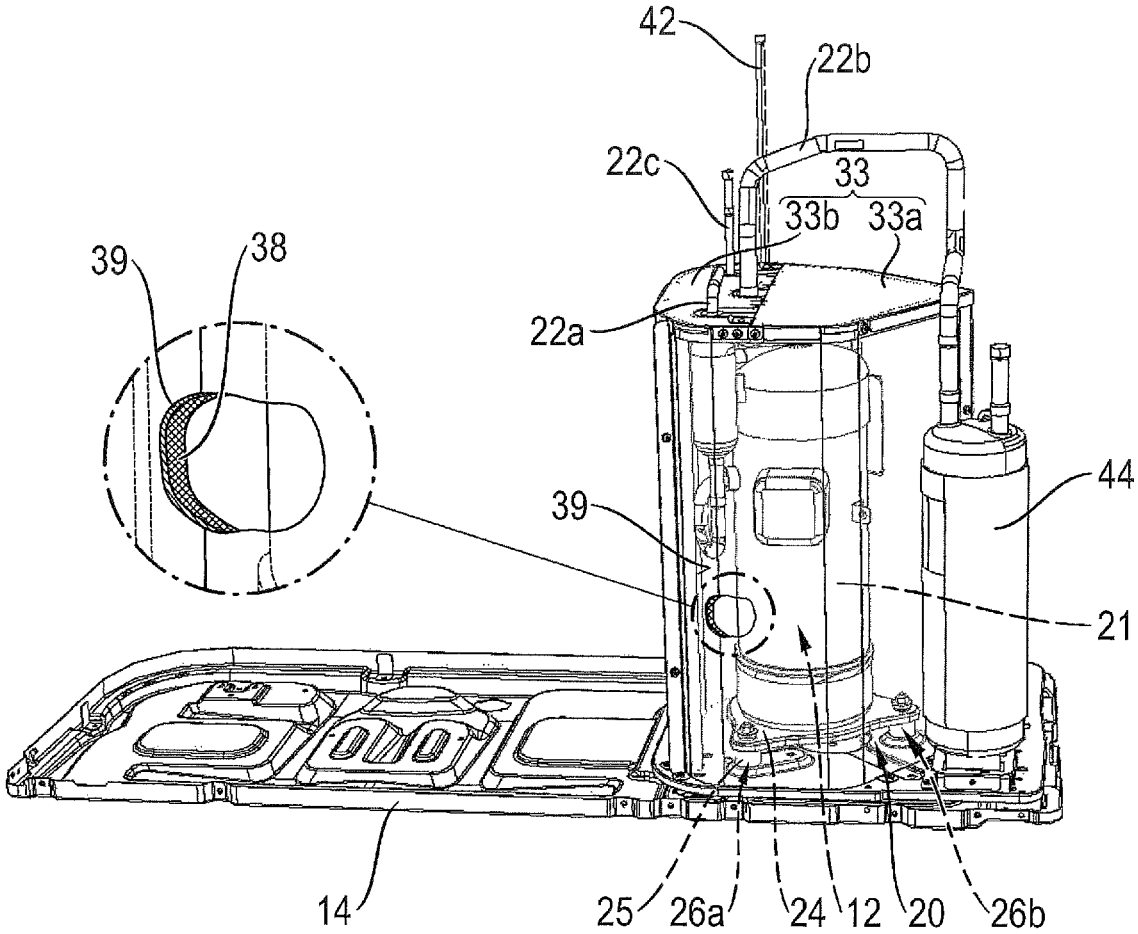

[Fig. 6]
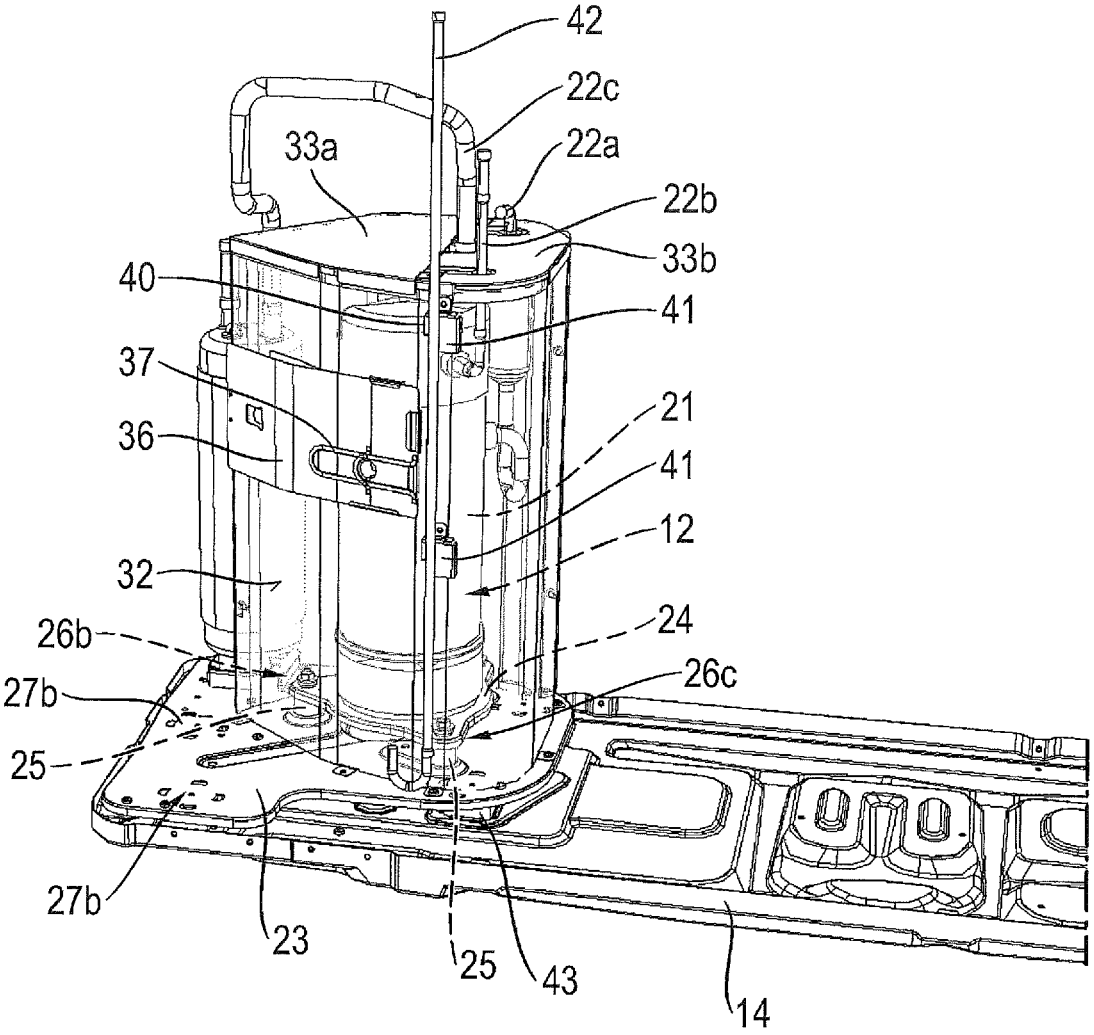

[Fig. 7]
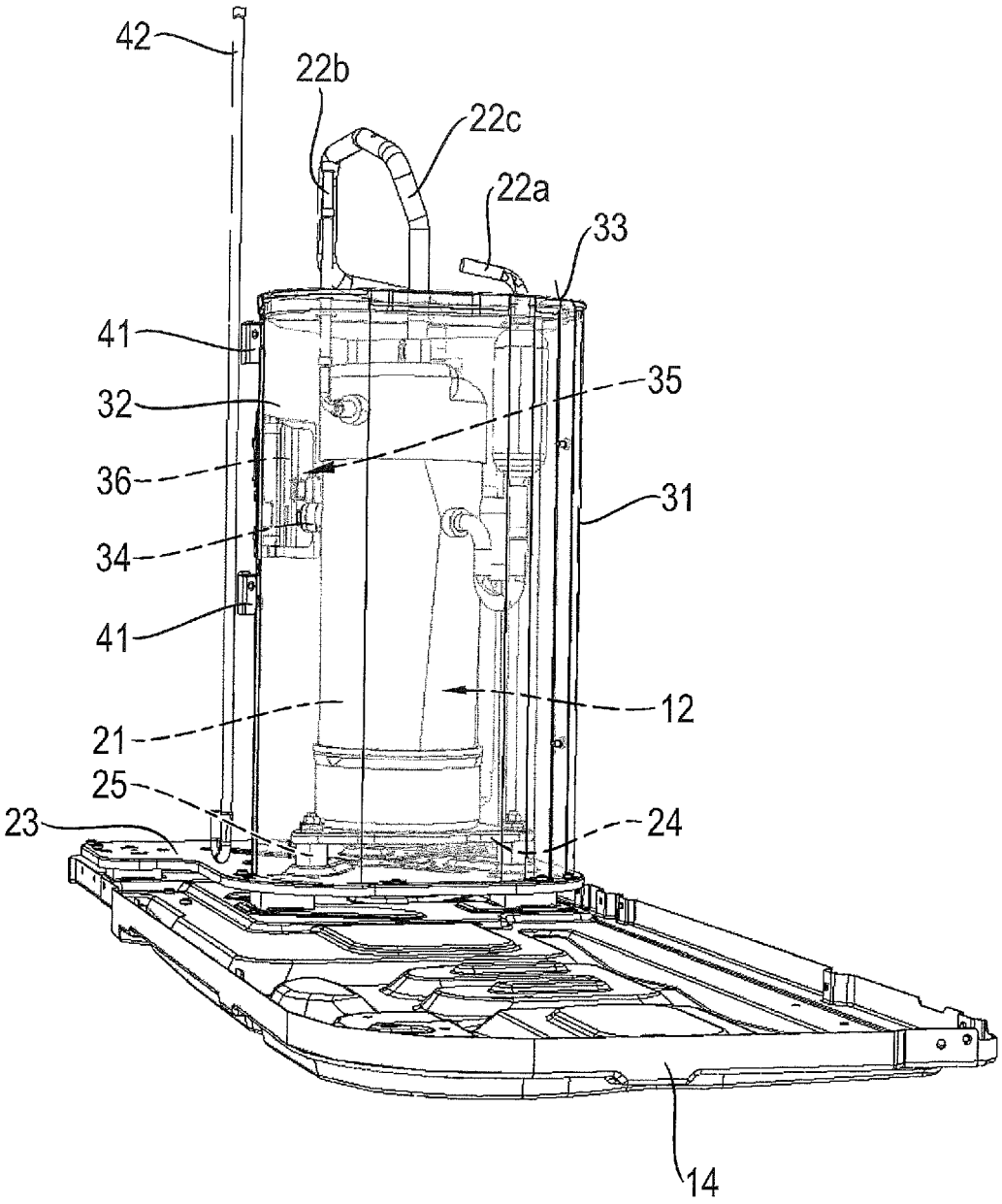

HEAT SOURCE UNIT FOR A HEAT PUMP

TECHNICAL FIELD

The present disclosure relates to heat pumps for cooling and/or heating purposes. In particular, the disclosure relates to split-type heat pumps comprising a heat source unit and at least one heat consumer unit.

BACKGROUND ART

Heat source units of heat pumps comprise an outer casing accommodating a portion of the refrigerant circuit of the heat pump, including a compressor. When talking about air heat pumps using air as heat source, the heat source units are primarily mounted outside the buildings and are also often referred to as outdoor units. Yet, in certain applications, the heat source units are also arranged inside the buildings. This applies for air heat pumps but also for heat pumps using a different heat source such as ground heat pumps.

Whereas the heat source units, as outdoor units, were in the past primarily arranged in hidden locations, such as on the roofs of buildings, the outdoor units are nowadays often installed in front of residential buildings and sometimes even right beside the front door.

From this perspective, but also with respect to heat source units disposed indoors, there is a desire to reduce the generation of noises. Those noises are inter alia generated by the compressor of the refrigerant circuit of the heat pump.

In the prior art, several attempts have been made to provide a sound insulation to avoid propagation of noises from the compressor to the outside of the heat source unit and/or to install damping mechanisms to avoid the propagation of vibrations from the compressor to other components within the heat source unit which may as well lead to the generation of noises. Some examples are given in EP 3 290 697 A1 describing a sound insulating cover for the compressor and EP 2 159 497 B1 showing a compressor being mounted to a bottom plate of an outdoor unit via a damping mechanism.

Yet, there is still the need for improvement with respect to the generation of noises by the heat source unit, particularly the compressor of the refrigerant circuit disposed within the heat source unit.

SUMMARY OF INVENTION

Accordingly, it is an aim to provide a heat source unit for a heat pump generating relatively little noises.

This aim may be achieved by a heat source unit as defined in claim 1. Embodiments may be found in the dependent claims, the following description and the accompanying drawings.

According to a first aspect, a heat source unit for a heat pump having a refrigerant circuit is suggested. The refrigerant circuit may at least comprise a heat source heat exchanger disposed in the heat source unit, a heat consumer heat exchanger, which may be disposed in an indoor unit, an expansion valve and a compressor connected by refrigerant pipes. The heat source unit comprises an outer casing comprising a bottom plate. The heat source unit may be mounted to a horizontal surface or brackets fixed to a vertical wall with the bottom plate being oriented horizontally. For this purpose, the feet may be provided at a lower side of the bottom plate, the feet being configured for mounting on the horizontal surface or the brackets.

Further, the heat source unit comprises a compressor assembly which is accommodated in the outer casing of the heat source unit. The compressor assembly comprises the compressor of the refrigerant circuit of the heat pump. The compressor has a compressor housing containing the compressing mechanism. The compressor housing including the compressing mechanism, i.e. the compressor, is supported (mounted) on a support plate. The support plate may be made from sheet metal and is relatively rigid in order to allow fixing of the compressor on the support plate. The support plate is mounted via dampers to the bottom plate. Moreover, a compressor casing is provided, which encloses the compressor including the compressor housing. The compressor casing is fixed to the support plate out of contact with the compressor housing. In this context, "out of contact" means that the compressor casing does not contact the compressor housing, but allows that components connecting to the compressor and the compressor housing, such as piping, directly or indirectly contact the compressor casing. In this case, it is however suggested to provide some elastic sealing between those components and the compressor casing. Furthermore, additional damping is provided by a damping mechanism arranged between the compressor, particularly the compressor housing, and the support plate.

In this first aspect, two level damping is realized between the bottom plate of the heat source unit and the compressor, particularly the compressor housing. More particular, the support plate is dampened by the dampers positioned between the support plate and the bottom plate relative to the bottom plate and the compressor, particularly the compressor housing containing the compressing mechanism, is dampened by the damping mechanism positioned between the compressor (compressor housing) and the support plate relative to the support plate. Accordingly, it can be reliably assured that no vibrations generated by the compressor are propagated from the compressor via its mounting structure to the bottom plate and, thereby the outer casing of the heat source unit. In addition, the compressor casing provides for a sound insulation insulating the compressor so that no or only little noises may propagate to the outside of the heat source unit. As the compressor casing is mounted to the support plate, being vibrationally decoupled from the compressor due to the damping mechanism, and is out of contact with the compressor housing, no or only little vibrations are propagated from the compressor to the compressor casing. This further reduces vibrations being propagated from the compressor to other components and finally to the outer casing of the heat source unit.

According to a second aspect, at least one additional (other than the compressor) refrigerant component of the refrigerant circuit of the heat pump is mounted to the support plate. Particularly, the components are directly mounted to the support plate. "Directly" in this context does not exclude any intermediate parts being located between the components in the support plate, but excludes that the components are mounted to the support plate we are other components of the refrigerant circuit, such as refrigerant pipes. Examples of such components are an accumulator, a receiver, a heat exchanger, such as a water plate heat exchanger, etc.

According to this aspect, the support plate may be used to dampen also vibrations originating from the other components of the refrigerant circuit mounted on the support plate relative to the bottom plate and thereby further decrease noises of the heat source unit.

According to a third aspect, the support plate comprises a plurality of mounting preparations so that a plurality of the refrigerant components is mountable on the support plate.

According to this aspect, the same support plate may be used in the manufacturing process for different types of units being differently equipped. For example, some units may only comprise an accumulator, but no water plate heat exchanger or at least a different heat exchanger than the water plate heat exchanger whereas other units comprise the accumulator and the water plate heat exchanger. Either of these units may use the same support plate.

According to a fourth aspect, the at least one additional refrigerant component of the refrigerant circuit of the heat pump is mounted to the support plate outside the compressor casing.

As a result, the compressor casing may be kept small and simple in shape and the available space within the heat source unit can be kept at a minimum.

According to a fifth aspect, the compressor casing is made of a rigid material, preferably sheet metal, and has a fixing structure to fix at least one component of the refrigerant circuit (other than the compressor) of the heat pump, preferably a refrigerant pipe of the refrigerant circuit of the heat pump, to the compressor casing.

According to this aspect, the compressor casing becomes multifunctional in that it serves for sound insulation and fixing of other components. Because the compressor casing is mounted on the support plate being dampened relative to the bottom plate and out of contact with the compressor housing, the compressor casing does basically not vibrate. Accordingly, refrigerant pipes may be kept straight and relatively long when being fixed to the compressor casing without the risk of being damaged. Otherwise, the refrigerant pipes would need to be bent various times to compensate for changes in length between fixing points due to vibrations.

According to a sixth aspect, the compressor casing is at least two layered comprising an outer layer and an inner layer.

Consequently, the sound insulating properties of the compressor casing may be improved.

According to a seventh aspect, the outer layer is made of a first material configured to absorb sounds in a first frequency range and the inner layer is made of a second material configured to absorb sounds in a second frequency range. In this context, the first frequency range and the second frequency range do at most overlap (i.e. the frequency ranges may also be entirely different without overlap). In an example, the first frequency range contains higher frequencies than the second frequency range.

Thus, a larger overall frequency range may be covered by the compressor casing improving the sound insulating properties.

According to an eighth aspect, the inner layer is less rigid than the outer layer.

If the outer layer is more rigid than the inner layer, higher frequencies are absorbed by the outer layer whereas lower frequencies are absorbed by the inner layer. In addition a more rigid outer layer enables the possibility to fix other refrigerant components to the compressor casing as particularized above.

In one particular example, the outer layer may be made of sheet-metal. The inner layer may be made of a needle felt. Yet, the present disclosure is not limited to those materials.

According to a ninth aspect, the compressor casing comprises a front part, a rear part and a top part, wherein the front part is detachable from the support plate separately from the rear part.

Heat source units have to be serviced from time to time. For this purpose, also the compressor may need to be inspected. In order to provide for ease of maintenance and serviceability, the front part of the compressor casing is detachable separately from the rear part and the top part so as to access the compressor. As a result, access to the compressor is easy and simple.

According to a tenth aspect, the rear part has a maintenance opening closed by a cover, the maintenance opening being arranged for giving access to parts of or parts mounted to the compressor. Such parts include but are not limited to sensors, such as a thermistor.

Some parts, such as sensors, tend to be damaged more frequently and require replacement. The maintenance opening closed by a cover allows easy access to those parts.

According to an eleventh aspect, at least part of a side wall of the outer casing is removable allowing access to and opening and/or removing of the cover.

In some heat source units, the arrangement of the heat source heat exchanger and the compressor require the refrigerant pipes to be primarily accommodated between the rear part of the compressor casing and a rear side of the outer casing of the heat source unit. Thus, when detaching a rear wall of the outer casing of the heat source unit no easy access to the rear part of the compressor casing and, hence, the cover is possible. According to this aspect, the outer casing however allows to remove at least a part of a side wall of the outer casing. In addition, the cover is configured to allow opening and/or removing of the cover from the rear part of the compressor casing from a side. Thus, it may be preferred that the cover is maintained in the closed position by a fastening mechanism which may be opened without the need of tools and preferably by using only one hand. As an example, a clamping lever may be embodied as a fastening mechanism. Accordingly, serviceability is improved according to this aspect.

According to a twelfth aspect, the compressor is fixed to the support plate via the damping mechanism only at a side of the compressor, which faces the front part of the compressor casing.

To put it differently, the locations at which the compressor is fixed to the support plate are easily accessible from a front side. Thus, upon removal of the front part of the compressor casing, those locations are accessible and the compressor may be detached from the support plate and withdrawn from the compressor casing from the front. Thus, there is no need to completely disassemble the compressor casing before being able to detach the compressor.

According to a thirteenth aspect, the compressor is supported on the support plate via the damping mechanism at least three discrete locations and fixed at only two of the locations.

Usually, compressors are mounted and fixed to the support plate via the dampers at three locations. In order to maintain the damping properties, the dampers are maintained at three locations, but the compressor is only fixed to the support plate at two of the locations. Thus, one may achieve that the compressor can be detached and removed from the compressor casing from the front still providing for the same damping properties.

According to a fourteenth aspect, wherein a plurality of compressor mounting preparations are provided on the support plate and being configured to allow mounting of at least two different types of compressors on the support plate.

According to this aspect, the same support plate may be used in the manufacturing process for different types of units being equipped with different type of compressor. For example, some units may embody a large capacity compressor whereas others may embody a small capacity compressor. Either type of the compressors may be mounted on the same support plate improving ease of manufacture of different types of units.

BRIEF DESCRIPTION OF DRAWINGS

A more complete appreciation of the present disclosure and many of the attendant advantages thereof will be readily obtained as the same becomes better understood by reference to the following detailed description when considered in connection with the accompanying drawings.

FIG. 1 shows a perspective view of a heat source unit (outdoor unit) in accordance with the present disclosure;

FIG. 2 shows a perspective view of the heat source unit of FIG. 1 with parts being removed to show an interior of a machine chamber of the heat source unit;

FIG. 3A shows an enlarged perspective of FIG. 2 with the compressor casing being shown in transparent;

FIG. 3B shows an enlarged perspective of FIG. 2 with the compressor casing being removed;

FIG. 4 shows a bottom view of FIG. 2 with the bottom plate being removed;

FIG. 5 shows a perspective front view of FIG. 3A with further components of the refrigerant circuit being removed, wherein the compressor casing is shown in transparent;

FIG. 6 shows a perspective back view of FIG. 5, wherein the compressor casing is shown in transparent; and FIG. 7 shows a perspective left view of FIG. 5, wherein the compressor casing is shown in transparent.

DESCRIPTION OF EMBODIMENTS

An embodiment will now be explained with reference to the drawings. It will be apparent to those skilled in the field of heat pumps from this disclosure that the following description of the embodiment is provided for illustration only and not for the purpose of limiting the invention as defined by the appended claims.

In the drawings, the compressor casing has been shown in transparent in some figures to make the parts housed in the compressor casing visible. The parts within the compressor casing have been referenced by using dotted lines.

FIG. 1 shows a perspective view of heat source unit 10 (in the shown embodiment an outdoor unit) of a split type heat pump. The heat pump comprises a refrigerant circuit, at least comprising a heat source heat exchanger 11, a compressor 12, a heat consumer heat exchanger (not shown), such as an indoor heat exchanger, and an expansion valve (not visible) connected by refrigerant pipes.

The shown outdoor unit 10 comprises an outer casing 13. The outer casing 13 has a bottom plate 14. Feet (not shown) for mounting the outdoor unit on a horizontal surface or via brackets to a vertical wall are fixed to the bottom plate 14.

Further, the outer casing 13 has a top plate 16 and a side plate 17. In the shown embodiment, the side plate 17 extends around a rearward corner of the outdoor unit 10 being connected to (integrally formed with/forming a one piece structure with) a back plate 18 of the outer casing 13.

As will be best visible from FIGS. 2 and 4, the heat source heat exchanger 11 occupies a part of the rear side of the outer casing 13 and the side of the outer casing 13 opposite to the side plate 17. The heat source heat exchanger 11 is "L"-shaped in a top view.

The front side of the outer casing 13 is closed by a front panel including a grille 19.

A compressor assembly 20 is accommodated in the outer casing 13 of the heat source unit 10 as shown in FIG. 2. The present disclosure mainly relates to mounting of the compressor assembly 20 within the heat source unit 10. In this context, reference is made to FIGS. 2 to 7.

The compressor assembly 20 (see FIGS. 5 to 7) comprises the compressor 12 of the refrigerant circuit of the heat pump. The compressor 12 comprises a compressor housing 21 containing the compression mechanism. The compressor housing 21 comprises at is lower end a fixation plate 24 for mounting the compressor 12.

Refrigerant pipes 22*a-c* of the refrigerant circuit are connected to the compressor housing 21 in order to feed refrigerant to the compressor 12 and discharge compressed refrigerant from the compressor 12.

Moreover, the compressor assembly comprises a support plate 23 for supporting the compressor 12 including the compressor housing 21. A set of three dampers 25 (damping mechanism), such as rubber dampers, is fixed at three locations 26*a-c* of the fixation plate 24 to the fixation plate 24. At two of said locations 26*a* and 26*b*, the dampers 25 are affixed to the support plate 23, whereby the fixation plate 24 and, hence, the compressor 12 including the compressor housing 21, are fixed to the support plate 23 via the dampers 25. At the third location 26*c*, the damper 25 is not fixed to (loose from) the support plate 25. The fixation of the dampers 25 to the fixation plate 24 and/or the support plate 23 is preferably obtained by using screws so that the dampers 25 are replaceable.

Due to the provision of the dampers 25, the compressor 12 including the compressor housing 21 and the fixation plate 24 are vibrationally decoupled from the support plate 23.

As may be taken from FIGS. 4 and 5 the support plate 23 comprises a plurality of compressor mounting preparations 28*a-c*. These mounting preparations 28*a-c* configured to allow mounting of different types of compressors 12, particularly compressors 12 having a different capacity.

For this purpose in the present example the mounting preparation 28*b* at the location 26*b* provides for one screw hole only. To the contrary, the mounting preparations 28*a* and 28*c* respectively at the locations 26*a* and 26*c* provide for two screw holes (an inner screw hole 29*a* and an outer screw hole 29*b*), respectively. Thus, the larger capacity compressor 12 may as shown be mounted using the outer screw holes 29*b*, whereas a not shown smaller capacity compressor may be mounted using the inner screw holes 29*a*.

The compressor assembly 20 further comprises a compressor casing 30. The compressor casing 30 encloses the compressor 12 including the compressor housing 21, the fixation plate 24 and the dampers 25. In an example, the compressor casing 30 is entirely closed except for the refrigerant pipes 22*a* to *c* entering and exiting the compressor casing 30. Yet, elastic sealings are provided between the refrigerant pipes 22*a* to *c* and the compressor casing 30 to avoid any openings at these locations. Thus, one may consider the compressor casing 30 to be "hermetic" to some extent.

The compressor casing 30 is fixed at its lower end to the support plate 23. In addition, the compressor casing 30 is sized so as to not contact with the compressor housing 21. To put it differently, there is always air in between the compressor housing 21 and an inner side surface of the compressor casing 30 facing the compressor housing 21.

The compressor casing comprises in the depicted embodiment three parts. The three parts consist of a front part 31, a rear part 32 and a top part 33. The top part 33 may comprise two parts, 33*a* and 33*b*. The front part 31 and the rear part 32 respectively independently connected to the support plate 23. In addition, the front part 31 is connected to the rear part 32 and the top part 33 and the rear part 32 is connected to the top part 33 and supports the top part. As a consequence, the front part 31 may be disconnected from the rear part 32 and the top part 33 as well as the support plate 23 without having to detach the rear part 32 and the top part 33 from the support plate 23 and each other.

When detaching the front part 31 of the compressor casing 30, one obtains access to the compressor 12 without the need to remove other parts of the compressor casing 30. Thus, the compressor 12 is easily accessible for inspection during maintenance. In addition and because the fixation plate 24 is only fixed via the dampers 25 to the support plate 23 at the locations 26*a* and 26*b*, the compressor 12 may even be easily removed from the compressor casing 30 through the front (if the front part 31 is removed). In particular, by loosening the fixation at the locations 26*a* and 26*b* and because the compressor 12 is not fixed at the location 26*c*, one may easily remove the compressor 12 if required. Yet, because the damper 25 is not omitted at the location 26*c* and the fixation plate 24 is still supported on the damper 25 at said location 26*c*, the damping characteristics are not deteriorated even though the damper is not fixed to the support plate 23.

Moreover, in many applications sensors or other parts are connected or related to the compressor 12 and/or attached to the compressor housing 21. In the present example a thermistor 34 (FIG. 7) is mounted to the compressor 12. Because sensors such as the thermistor 34 tend to require more frequent maintenance or replacement, the compressor casing 30 is additionally provided with a maintenance opening 35 closed by a cover 36. The cover 36 which is best visible in FIGS. 6 and 7 is at one end hinged to the rear part 32 of the compressor casing 13. A fastening structure 37 is provided at the opposite end to fix the cover 36 in the closed position. Accordingly, if maintenance, such as replacement of the thermistor 34, is required, one may operate the fastening structure 37 to loosen the cover 36 at the opposite end so that the cover 36 may be opened or even be detached. Subsequently, the thermistor 34 may for example be replaced and the cover 36 again closed and fastened to the rear part 32 by the fastening structure 37. Hence, neither one of the parts 31 to 33 of the compressor casing 30 needs to be removed for replacing the thermistor 34.

Even further and as explained earlier, the back plate 18 and the side plate 17 are integrally formed and may be removed for giving access to a machine chamber accommodating the compressor assembly 20 and other components of the refrigerant circuit. As will be apparent from FIG. 2, a plurality of refrigerant pipes is located between the rear part 32 of the compressor casing 30 and the rear plate 18. Thus, even when the rear plate 18 is removed, it is difficult to reach the rear part 32 of the compressor casing 30 and hence the cover 36. Accordingly, the cover 36 is arranged on the rear part 32 so as to be accessible via the side of the outer casing 13 corresponding to the side plate 17. Hence, removing the side plate 17 allows access to the cover 36. Referring to FIG. 6, a user may access the cover 36 from the left side.

Further, the fastening structure 37 is configured so as to allow opening and/or removing of the cover 36 without the need of a tool. In one example, the cover may be slid into a guide and held in a direction towards the rear plate 18 by the guide. To put it differently the cover 36 is slid towards the right in FIG. 6 into the closed position engaging with the guide so that a form fit in a direction perpendicular to the sliding direction is obtained. Subsequent, a clamping lever may be used to fix the cover 36 in that position. As it may be difficult to reach the cover 36 by a tool it is preferred that the clamping lever may be operated without the use of tools and preferably by using one hand only.

Moreover, the compressor casing 30 comprises two layers, an inner layer 38 and an outer layer 39 (see partial broken view in FIG. 5). In the present example, the outer layer 39 is more rigid than the inner layer 38. In particular, the outer layer 39 is made of sheet-metal and therefore rigid. As one example, a sheet-metal having a thickness between 0.6 millimeter and 1 millimeter may be used as outer layer 39. The inner layer 38 is made of an elastic material, such as needle felt.

As a consequence, the sound insulation properties of the compressor casing 30 are improved. In particular, the more rigid outer layer 39 (sheet-metal layer) is able to absorb frequencies in a relatively high frequency range (first frequency range). To the contrary, the less rigid inner layer 38 (needle felt layer) which is soft and elastic, is able to absorb frequencies in a relatively low frequency range (second frequency range). Even though the first and second frequency ranges may overlap, the second frequency range comprises frequencies which are lower than the frequencies in the first frequency range and vice versa. Accordingly, the compressor casing 30 of the present disclosure is able to absorb noises in a broader frequency range.

Moreover, by configuring the outer layer 39 of a relatively rigid material such as sheet-metal, the outer layer 39 becomes multifunctional. On the one hand, it serves to absorb the high-frequency noises and, on the other hand, it may be used to support the less rigid in a layer, enables fixation of the compressor casing 30 to the support plate 23 and loves to even attach other components of the refrigerant circuit of the heat pump to the compressor casing 30. Yet, the latter is only possible, because the compressor casing 30, i.e. the outer layer 39 is vibrationally decoupled from the compressor 12 via the dampers 25 and configured to be out of contact with the compressor 12 including the compressor housing 21 and the fixation plate 24. Accordingly, the compressor casing 30 does itself not vibrate or at least not in to the same extent as the compressor 12.

As particularly shown in FIGS. 6 and 7, the compressor casing 30 (in the example the rear part 32) has at least one engagement member 40 (in the present example two such engagement members 40 are provided) fixed to the compressor casing 30, particularly the outer layer 39 thereof. The component of the refrigerant circuit of the heat pump which in the present example is fixed to the compressor casing 30 is a refrigerant pipe 42. The refrigerant pipe 42 has a least one engaging member 41 (in the present example 2 such engaging members 41 are provided) fixed to the refrigerant pipe 42. The engagement member 40 and the engaging member 41 represent the fixing structure. The engaging member 41 is engaged with the engaging member 41 to fix the refrigerant pipe 42 to the compressor casing 30.

In one particular example, the engagement member 40 may be shaped like a T-guide in cross section and the engaging member 41 may have a C-shaped cross section catching behind the horizontal legs of the "T". The engaging member 41 may further have a stop at an upper end. Thus, the engaging members 41 of the refrigerant pipe 42 may, together with the refrigerant pipe 42, be slid from the top onto the engagement members 40 at the compressor casing 30, wherein the movement is limited by the stop. Thus, the refrigerant pipe 24 is held in a horizontal direction by the cross-section engaging behind the horizontal legs of the "T" and in the vertical direction by the stop. A similar fastening structure 37 may as well be implemented in which the engagement member 40 forms a hole and the engaging member 41 is formed like a hook hooking into the whole of the engagement member 40. The mounting process would then be the same as explained above.

Due to the secure fixation of the refrigerant pipe 42 to the compressor casing 30 and because the compressor casing 30 is vibrationally decoupled from the compressor 12 as explained above, the refrigerant pipe 42 may be relatively long and straight without the risk of becoming damaged.

Furthermore, the support plate 23 is fixed to the bottom plate 14 of the heat source unit 10. In particular, the support plate 23 is mounted to the bottom plate 14 via a second set of dampers 43 (five dampers 43 are provided in the present embodiment (FIG. 4)). In an example, the dampers 43 are screwed to both the support plate 23 or more particularly a lower side of the support plate 23 and an upper side of the bottom plate 14. Thus, the dampers 43 may even be replaced if it becomes necessary over the lifetime of the heat source unit 10.

In addition, other components than the compressor 12 including the compressor housing 21 and the fixation plate 24 as well as the compressor casing 30 may be mounted to the support plate 23. Examples of those components are components of the refrigerant circuit of the heat pump such as an accumulator 44 or a water plate heat exchanger. Yet, also other components may be mounted on the support plate 23. It is particularly beneficial to mount those components on the support plate 23 which also tend to produce or propagate vibrations and, therefore, noises. Because the support plate 23 is vibrationally decoupled from the bottom plate 14 via the dampers 43 those vibrations and noises are hence not transferred to the bottom plate 14 and hence the outer casing 13 of the heat source unit 10.

In the different type of the heat source units 10, is a different type of those components or different number of the components may be mounted to the support plate 23. In order to enable the use of the same support plate 23 for plurality of different types of heat source units 10, the support plate 23 comprises a plurality of mounting preparations 27*a,b*. The mounting preparations 27*a* are used for mounting the accumulator 44.

In the present example, the mounting preparations 27*b* are provided for mounting a water plate heat exchanger (not shown) which is required for some types of heat source units 10. If as in the present example the water plate heat exchanger is not part of the respective heat source unit 10, the mounting preparations 27*b* are not used but still present.

In addition and as will be apparent from particularly FIGS. 5 and 6, the accumulator 44 is mounted to the support plate 23 outside the compressor casing 30. Accordingly, the size of the compressor casing 30 may be minimized so as to accommodate a minimum space within the heat source unit 10.

It is to be understood that the present description of an embodiment is not considered to be limiting. Rather several modifications may be realized by the skilled person. For example, a different number of dampers 25 or dampers 43 may be provided. In addition, other components than the accumulator 44 may as well be supported on the support plate 23. The same also applies with respect to the refrigerant component fixed to the compressor casing 30, which in the example is the refrigerant pipe 42. However, also other components may be fixed to the compressor casing 30.

REFERENCE SIGNS LIST

10 heat source unit (outdoor unit)
11 heat source heat exchanger
12 compressor
13 outer casing
14 bottom plate
16 top plate
17 side plate
18 back plate
19 grille
20 compressor assembly
21 compressor housing
22*a-c* refrigerant pipes
23 support plate
24 fixation plate
25 damper
26*a-c* locations
27*a-b* mounting preparations
28*a-c* compressor mounting preparations
29*a-b* inner and outer screw hole
30 compressor casing
31 front part
32 rear part
33 top part
34 thermistor
35 maintenance opening
36 cover
37 fastening structure
38 inner layer
39 outer layer
40 engagement member
41 engaging member
42 refrigerant pipe
43 damper
44 accumulator

CITATION LIST

Patent Literature

[PATENT LITERATURE 1] EP 3 290 697 A1
[PATENT LITERATURE 2] EP 2 159 497 B1

The invention claimed is:

1. A heat source unit for a heat pump having a refrigerant circuit, the heat source unit comprising:

an outer casing comprising a bottom plate; and a compressor assembly accommodated in the outer casing, the compressor assembly comprising a compressor of the refrigerant circuit of the heat pump including a compressor housing, a support plate supporting the compressor, the support plate being mounted via dampers to the bottom plate, and a compressor casing enclosing the compressor housing, wherein a damping mechanism is arranged between the compressor and the support plate, and the compressor casing is fixed to the support plate out of contact with the compressor housing, wherein the compressor casing comprises a front part, a rear part and a top part, wherein the front part is detachable from the support plate separately from the rear part, and wherein the rear part has a maintenance opening closed by a cover, the maintenance opening being arranged for giving access to the compressor or a part attached to or related to the compressor.

2. A heat source unit according to claim 1, wherein at least part of a side plate of the outer casing is removable allowing access to and opening and/or removing of the cover.

3. A heat source unit according to claim 2, wherein the compressor is fixed to the support plate via the damping mechanism only at a side of the compressor, which faces the front part of the compressor casing.

4. A heat source unit according to claim 1, wherein the compressor is fixed to the support plate via the damping mechanism only at a side of the compressor, which faces the front part of the compressor casing.

5. A heat source unit for a heat pump having a refrigerant circuit, the heat source unit comprising:

an outer casing comprising a bottom plate; and a compressor assembly accommodated in the outer casing, the compressor assembly comprising a compressor of the refrigerant circuit of the heat pump including a compressor housing, a support plate supporting the compressor, the support plate being mounted via dampers to the bottom plate, and a compressor casing enclosing the compressor housing, wherein a damping mechanism is arranged between the compressor and the support plate, the compressor casing is attached to the support plate at a position apart from the dampers, the compressor casing being out of contact with the compressor housing, and the compressor is fixed to the support plate via the damping mechanism only at a side of the compressor, which faces the front part of the compressor casing.

6. A heat source unit according to claim 5, wherein the compressor is supported on the support plate via the damping mechanism at least three discrete locations and fixed at only two of the locations.

* * * * *